United States Patent [19]

Coley et al.

[11] Patent Number: 4,495,678

[45] Date of Patent: Jan. 29, 1985

[54] BUTTON FOR RECEIVING AND SECURING A FABRIC COVERING THEREFOR AND FABRIC-COVERED BUTTON ASSEMBLY FORMED THEREWITH

[75] Inventors: Charles R. Coley, Blowing Rock; J. Roger Hall, Hickory, both of N.C.

[73] Assignee: Plus One Ltd., Blowing Rock, N.C.

[21] Appl. No.: 483,569

[22] Filed: Apr. 11, 1983

[51] Int. Cl.[3] ..... A44B 1/12

[52] U.S. Cl. ..... 24/113 R; 24/90 R; 24/90 C; 24/90 E; 24/92

[58] Field of Search ..... 24/113 R, 113 MP, 90 B, 24/90 C, 90 E, 92, 94, 101 R, 102 T, 230.5 TP; 5/472

[56] References Cited

U.S. PATENT DOCUMENTS

| | | | |
|---|---|---|---|
| 1,452,052 | 4/1923 | Nalle | 24/90 C |
| 1,489,778 | 4/1924 | Merzinger | 24/90 E |
| 1,682,771 | 9/1928 | Butler | 24/90 C |
| 2,075,722 | 3/1937 | Illsche | 24/90 C |
| 2,127,363 | 8/1938 | Illsche | 24/90 C |
| 2,210,799 | 8/1940 | Denny | 24/90 C |
| 2,548,004 | 4/1951 | Duefrene | 24/90 C |
| 3,829,935 | 8/1974 | Critchfield | 24/90 B |
| 3,908,236 | 9/1975 | Shepherd | 24/90 B |
| 3,934,314 | 1/1976 | Whysall | 24/113 R |
| 4,012,812 | 3/1977 | Black | 24/90 B |
| 4,123,825 | 11/1978 | Messler et al. | 24/90 B |
| 4,169,302 | 10/1979 | Forguson | 24/113 R |
| 4,194,272 | 3/1980 | Taffurelli | 24/90 E |
| 4,387,488 | 6/1983 | Kanzaka | 24/92 |

FOREIGN PATENT DOCUMENTS

| | | | |
|---|---|---|---|
| 203770 | 6/1959 | Austria | 24/113 R |
| 0008986 | 3/1980 | European Pat. Off. | 5/472 |
| 408824 | 1/1945 | Italy | 24/92 |

*Primary Examiner*—Victor N. Sakran

*Attorney, Agent, or Firm*—Richards, Shefte & Pinckney

[57] ABSTRACT

A button for receiving and holding a fabric covering which includes a base element having a main body with a convex-shaped exterior surface, a flat underside and a tapered central opening and a cap member to be outwardly covered by a fabric piece and having a concave interior surface for receiving the main body and engaging therebetween the edge of the exterior fabric covering, a central tapered projection for insertion in the tapered opening, and an annular lip for extending along the underside to retain the base element in the cap member. The tapered projection is larger than the tapered opening and the main body is scored along a radial line extending outwardly from the opening for radial expansion, thereby facilitating radial expansion of the main body as the projection is inserted into the opening to greater depths to engage the fabric edge. Thus, the button adapts readily to fabric coverings of varying thicknesses by varying the amount of radial expansion of the main body. In one form, an interior lip of the cap member engages in a recess of the base element to aid in retaining it in the cap member. In another form, the base element has annular ridges and the cap member has annular grooves which engage the fabric edge and each other to aid in retaining it in the cap member.

18 Claims, 5 Drawing Figures

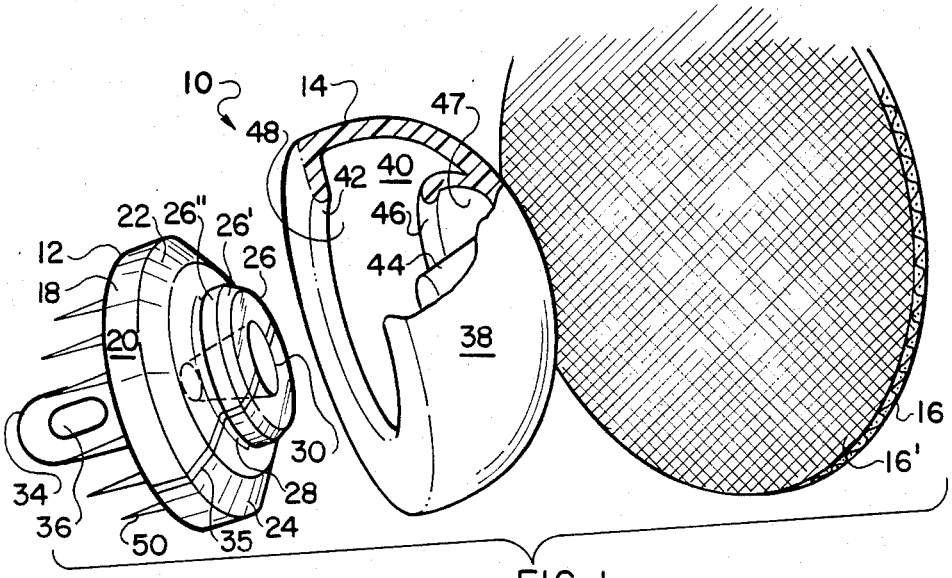
FIG. 1
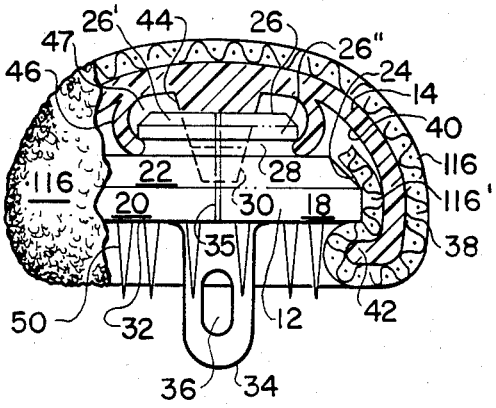
FIG. 2
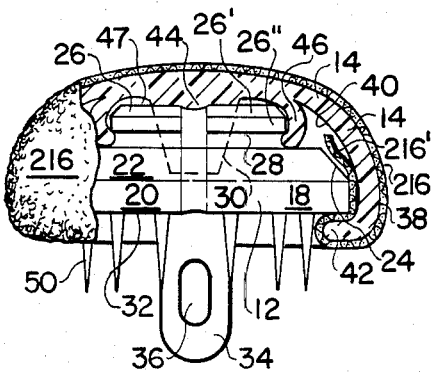
FIG. 3
FIG. 4
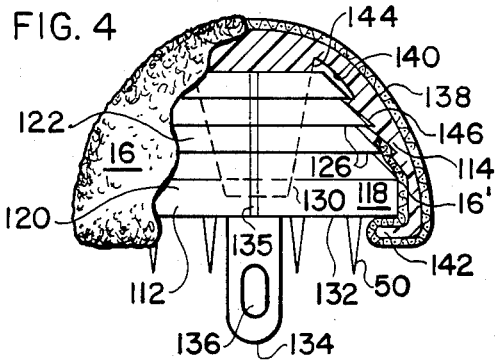

BUTTON FOR RECEIVING AND SECURING A FABRIC COVERING THEREFOR AND FABRIC-COVERED BUTTON ASSEMBLY FORMED THEREWITH

BACKGROUND OF THE INVENTION

The present invention relates to buttons and particularly to fabric covered button assemblies such as are used in apparel, upholstery and the like.

Buttons generally have many and varied uses in numerous fields and, in certain embodiments such as the tufted upholstery of furniture, the manufacture of certain forms of wearing apparel, e.g., women's dresses, and like uses, it has long been conventional practice to enhance the overall aesthetic appearance of the basic article by covering the buttons being used therein with the same fabric or similar material employed in the basic article. Typically, a particular button construction is employed for this purpose basically using a button cap or shell to be covered by the fabric or material and adapted to be affixed to a collet or other body member clamping the fabric edges to hold the fabric in place about the cap. Examples of this type of button construction are disclosed in U.S. Pat. Nos. 3,829,935; 3,908,236; 4,012,812; and 4,123,825.

While many various forms of this basic type of covered button assembly have been proposed and used in the past, virtually all such button assemblies suffer the common disadvantage that the fabric covered cap is likely when placed under stress to separate from the main body of the button, commonly referred to in the art as "button popping". Once a button cap has become separated, it is difficult if not impossible to securely re-affix it to the main body of the button, thereby leaving the unsightly main body visible in the article and sometimes creating a potential hazard in the continued use of the article if the main body has any sharp edges or is otherwise likely to cut or be snagged on other articles.

Various types of arrangements have been proposed for securing the button cap and the body member together against separation but such arrangements either do not sufficiently prevent separation of the two components or do not facilitate use of the same cap and body member with differing covering fabric thicknesses or suffer both disadvantages. For instance, in one known form of this basic type of covered button assembly, a hollow hub having an interior serration is formed on the inner surface of the button cap and a cone-shaped portion is formed on the body member to be engaged in the hub to lock the cap and body member together. Although this construction is relatively effective for locking the button components together, it is relatively ineffectice for adapting to securely hold fabrics of differing thicknesses.

While it is considered advantageous that a button assembly be capable of use with varying thicknesses of fabric, conventional button assemblies are generally designed with limited tolerances between the button cap and main body to provide a reasonably tight fit for the purpose of securely holding the fabric in place therebetween, and such button assemblies are, therefore, usable in most instances with only a limited range of fabric thicknesses, and different button assemblies and/or closing dies are required for different fabric thicknesses. Moreover, incorrect use of such button assemblies with fabrics of thicknesses other than those for which the button assemblies are intended, which often occurs, creates an even greater likelihood of the incidence of button popping.

In contrast, the present invention provides a button which is particularly constructed for secure assembly with fabrics of widely varying thicknesses and to conform in assembly to the particular thickness of fabric being used to securely hold the fabric in place.

SUMMARY OF THE INVENTION

The present button basically includes an expandable base element and a cap member adapted to receive the base element for engaging fabric therebetween. The base element has a shaped fabric-engaging exterior surface portion and a second surface portion extending inwardly with respect to the periphery of the exterior surface portion. An opening extends into the base element generally centrally of its exterior surface portion. The cam member is formed of resilient material and has an interior surface portion shaped to receive the base element, an annular lip extending inwardly for disposition immediately adjacent the second surface portion of the base element, and a projection extending generally centrally from the interior surface portion for insertion into the opening of the base element. At least a portion of the projection is larger than the opening and the projection is suitably shaped to cause increasing radial expansion of the base element as the projection is inserted to predetermined depths into the opening of the base element. Thus, in assembly with a fabric piece covering the cap member outwardly thereabout, the base element is received by the cap member with the projection of the cap member extending into the opening of the base element a predetermined depth to cause radial expansion of the base element to securely engage the fabric piece between the base element and the cap member, and to prevent separation of the base element and the cap member.

In the preferred embodiment, the opening of the base element is inwardly tapered into the base element and the projection of the cap member is inwardly tapered along its projecting length for causing the increased radial expansion of the base element in substantially direct relation to the depth of insertion of the projection in the opening. To facilitate such expansion of the base element, it is scored outwardly from its central opening. Preferably, the exterior surface portion of the base element is generally convex in shape and the interior surface portion of the cap member is generally concave in shape.

In one embodiment of the button, the exterior surface portion of the base element includes annular ridges about the cental opening and the interior surface portion of the cap member includes annular grooves about the projection for frictionally holding the fabric therebetween. In another embodiment, the cap member includes a second annular lip extending from the interior surface portion about, and inwardly toward, the projection, and the base element includes an annular recess about the opening to receive the second annular lip when the base element is received by the cap member.

BRIEF DESCRIPTION OF THE DRAWINGS

FIG. 1 is an exploded view in perspective of the preferred embodiment of the button assembly of the present invention;

FIG. 2 is a vertical cross-sectional view of the button assembly of FIG. 1 in assembled form with a relatively thick covering fabric;

FIG. 3 is a vertical cross-sectional view of the button assembly of FIG. 1 in assembled form with a relatively thin covering fabric;

FIG. 4 is a vertical cross-sectional view of an alternate embodiment of the button assembly of the present invention.

DESCRIPTION OF THE PREFERRED EMBODIMENT

Figure 5:
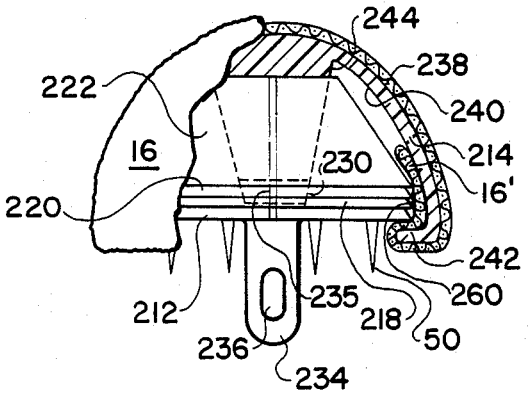
FIG. 5 is a vertical cross-sectional view of another alternate embodiment of the button assembly of the present invention.

Referring now to the accompanying drawings and initially to FIG. 1, the button assembly of the present invention is shown in non-assembled form generally at 10 and basically includes a base element 12, sometimes referred to in the trade as a collet, a cap member 14 adapted to receive the base element 12, and a fabric piece 16 adapted to cover the exterior surface of the cap member 14 with the fabric's annular edge engaged between the base element 12 and cap member 14 to hold the fabric piece 16 in place.

The base element 12 is molded of a suitable expandable material, such as plastic, and includes a main body 18 having a disk-shaped portion 20 and a frusto-conically shaped portion 22 extending upwardly and inwardly therefrom to provide a fabric-engaging exterior surface 24. A secondary body portion 26 of substantially the same shape as, but smaller than, the main body 18 extends centrally upwardly from the main body 18 and an annular recess 28 is formed in the base of the secondary body portion 26 immediately adjacent the main body 18. An inwardly-tapered opening 30 is formed centrally into the secondary body portion 26 and the main body 18. The underside 32 of the disk-shaped portion 20 is substantially flat and a mounting stem 34 having an eyelet 36 formed therethrough depends centrally from the underside 32. Score lines 35 are formed in the main and secondary bodies 18,26 radially outwardly from the central opening 30 to facilitate radially outward expansion of the main and secondary bodies 18,26.

The cap member 14 is molded of a suitable resilient material, such as plastic, in the form of a rounded shell having a concave exterior surface portion 38 and an interior peripheral surface portion 40. The shell includes an annular lip 42 extending radially inwardly at the outermost portion thereof. A projection 44 extends centrally from the interior surface portion 40 of the shell and the projection 44 is tapered inwardly along its length. A second annular lip 46 extends from the interior surface portion 40 about and inwardly toward the tapered projection 44 forming an annular channel spacing 47 therebetween.

The cap member 14 thus provides an interior receiving area 48 defined by its interior surface portion 40, its annular lips 42,46, and its projection 44, which are shaped and dimensioned to receive compatibly and to retain the main and secondary bodies 18,26 of the base element 12 within the receiving area 48. The diametric dimension of the cap member 14 at the radially inwardmost edge of the annular lip 42 is notably at least approximately the same as or slightly larger than the smallest diametric outer dimension of the frusto-conical portion 22 of the main body 18 of the base element 12, and is smaller than the diametric outer dimension of the disk portion 20 thereof. The tapered projection 44 is formed so that its diametric dimensions, along its projecting length, are somewhat greater than the corresponding diametric dimensions of the tapered opening 30 so that insertion of the projection 44 in the opening 30 will cause expansion of the base element 12 as discussed in greater detail below. The projecting length of the second annular lip 46 is slightly greater than the axial dimension of the secondary body portion 26. The diametric dimension between opposite points of the lip 46 at its radially inwardmost edge is approximately the same as or only slightly larger than the smallest diametric outer dimension of the frusto-conical portion 26′ of the secondary body portion 26, and is smaller than the diametric outer dimension of the disk portion 26″ thereof.

The fabric piece 16 is cut from a selected fabric material in a substantially circular shape of a diameter sufficiently greater than the diametric peripheral dimension of the cap member 14 about its exterior surface portion 38 and along its annular lip 42 thereby to adapt the fabric piece 16 to outwardly cover the cap member 14 with a sufficient excess of the fabric piece 16 at its annular fabric edge portion 16′ to be turned about the lip 42 and to extend into the receiving area 48 of the cap member 14.

The assembling of the base element 12, the cap member 14 and the fabric piece 16 will thus be understood. The fabric piece 16 is initially positioned symmetrically on the exterior surface portion 38 of the cap member 14 and is conformed thereto and the annular fabric edge portion 16′ is wrapped about the lip 42 to extend thereabout and into the receiving area 48. The base element 12 is then received by the cap member 14 by insertion first of the secondary body portion 26 followed by the main body portion 18 of the base element 12 into the receiving area 48 of the cap member 14. The frusto-conical portion 22 of the main body 18 of the base element acts to gradually expand the annular lip 42 of the cap member 14 to permit passage therebetween of the disk portion 20. The resiliency of the plastic material of which the cap member 14 is formed permits such expansion of the lip 42 and causes the lip 42 to be urged elastically to return to its original shape following receipt of the main body 18 into the receiving area 48, whereby the lip 42 closes about the main body 18 to extend immediately adjacent its flat underside 32 and to engage the annular fabric edge portion 16′ between the lip 42 and the underside 32. Upon receipt of the main and secondary bodies 18,26 in the receiving area 48, the projection 44 of the cap member 14 is caused to be inserted into the opening 30 of the base member 12 and the second annular lip 46 is expanded by the secondary body portion 26 of the base element 12 to receive it in the annular spacing 47 between the lip 46 and the projection 44 with the inwardly projecting edge of the lip 46 being received in the recess 28 at the base of the secondary body poriton 26. The insertion of the projection 44 into the central opening 30 causes radially outward expansion of the main and secondary bodies 18,26, and score lines 35 assist in permitting such expansion. Also, the secondary body portion 26 is correspondingly expanded radially outwardly to tighten the fit thereof with the lip 46 in the recess 28, and the expanded main body 18 pinches the annular fabric edge between the fabric engaging surface 24 and the interior surface portion 40 of the cap member 14.

As will be understood, the above-described assembling of the base element 12, the cap member 14 and the fabric piece 16 will ordinarily be performed by a conventional tool or die press. Various forms of such apparatus are known and any of a variety thereof may be used for or adapted to be used for the present button assembly. Such apparatus form no part of the present invention and accordingly are not described herein.

As will be understood, the above-described compatible arrangment of the base element 12 and the cap member 14 permits them to adapt themselves, when assembled, for secure engagement and holding of fabric pieces having a wide range of varying thicknesses. The annular edge portion of a relatively thick fabric will necessarily occupy a greater amount of space within the receiving area 48 of the cap member 14 than will a relatively thin fabric. Accordingly, the annular edge portion of a relatively thick fabric will more greatly reduce the available radial space within the receiving area 48 for occupation by the main body 18 of the base member 12 than will a relatively thin fabric. The taper and relative dimensioning of the projection 44 of the cap member 14 and of the opening 30 of the base element 12 are effective to cause selectively varying degrees of radial expansion of the main and secondary body portions 18,26 of the base element 12 in direct relation to the depth of insertion of the projection 44 into the opening 30. Thus, with any given fabric covering 16 employed in the button assembly 10, the degree to which the particular thickness of the fabric edge portion 16' restricts the radial space of the receiving area 48 available for the main body 18 of the base element 12 will determine the degree of radial expansion of the main body 18 necessary to securely engage the fabric edge portion 16' between the fabric engaging surface 24 of the base element 12 and the interior surface portion 40 of the cap member 14, which in turn will determine the degree to which the projection 44 of the cap member 14 must be inserted into the opening 30 of the base element 12 necessary to achieve such required radial expansion of the main body 18 of the base element 12. The axial dimension of the receiving area 48 of the cap member 12 is slightly greater than the total axial dimension of the main and secondary bodies 18,26 of the base element 12 to permit the selective insertion thereof into the receiving area 48 to varying extents thereby to permit the selective insertion of the projection 44 of the cap member 14 into the opening 30 of the base member 12 to correspondingly varying depths. The relatively greater axial dimension of the second lip 46 of the cap member 14 with respect to that of the secondary body portion 26 of the base element 12 permits the lip 46 to be engaged in the recess 28 of the secondary body portion 26 in all received dispositions of the main and secondary bodies 18,26 in the receiving area 48. Thus, with any given fabric covering 16 employed in the button assembly 10, the main and secondary bodies 18,26 of the base element 12 are inserted into the receiving area 48 of the cap member 14 to an extent inversely related to the fabric thickness sufficient to cause the projection 44 to be inserted into the opening 30 to a depth sufficient to radially expand the main body 18 into secure gripping engagement of the annular fabric edge portion 16' between the fabric engaging surface 24 of the main body 18 and the interior surface portion 40 of the cap member 14. As will be understood, this adaptation to the fabric thickness occurs substantially automatically in each instance since, once the necessary degree of insertion of the base element 12 into the cap member 14 is reached and fabric engagement occurs, there will be resistance to any further insertion of the base element 12.

In FIGS. 2 and 3, there is shown the button assembly 10 of FIG. 1 in assembled form with relatively thick and relatively thin fabric coverings, respectively. For purposes of enhancing the illustration of the above-discussed adaptability of the base element 12 and cap member 14 to fabrics of differing thicknesses, the differences in the dispositions of the button assembly components of each Figure have been somewhat exaggerated and therefore such Figures are to be understood to be somewhat schematic in form. As seen in FIG. 2, a relatively thick fabric covering 116 is employed. Because of the correspondingly greater space in the receiving area 48 of the cap member 14 occupied by the annular fabric edge portion 116', the main and secondary bodies 18,26 of the base element 12 are inserted into the receiving area 48 to only a partial extent and therefore the projection 44 is inserted into the opening 30 to only a partial depth whereby the main body 18 of the base element 12 is expanded radially only enough to engage the fabric edge portion 116' between the main body 18 and the interior surface portion 40 of the cap member 14. The secondary body portion 26 of the base element 12 is received in the channel 47 between the annular lip 46 and the projection 44 only to a sufficient depth for engagement of the annular lip 46 in the recess 28. As seen in FIG. 3, a relatively thin fabric covering 216 is employed. Because of the correspondingly lesser space in the receiving area 48 occupied by the annular fabric edge portion 216', the main and secondary bodies 18,26 of the base element 12 are inserted into the receiving area 48 to a substantially complete extent and therefore the projection 44 is substantially fully inserted into the opening 30 whereby the main body 18 of the base element 12 is substantially fully expanded radially to engage the fabric edge portion 216' between the main body 18 and the interior surface portion 40. The secondary body portion 26 is received in the channel 47 between the annular lip 46 and the projection 44 to a substantially complete extent causing the annular lip 46 to be flexed radially outwardly while still engaged in the recess 28 for secure engagement between the lip 46 and secondary body portion 26. Notably, the annular lip 42 is closed about the main body 18 extending along its underside 32 in each assembled form of the button assembly to retain the base element 12 in assembly with the cap member 14.

An alternate embodiment of a base element 112 and a cap member 114 is shown in FIG. 4. In such embodiment, the base element 112 includes a main body 118 having a circular disk portion 120 and a generally frusto-conical portion 122 extending therefrom but does not include a secondary body portion 26. The frusto-conical portion 122 has a substantially greater axial extent than the frusto-conical portion 22 and includes a plurality of annular ridges 126 thereabout. Otherwise, the base element 112 is substantially of the same construction as the base element 12, including a tapered central opening 130 in the main body 118, score lines 135 in the main body 118 extending radially outwardly from the opening 130, a flat underside 132 of the main body 118, and a central stem 134 with an eyelet 136 therein depending centrally from the underside 132. The cap member 114 is formed as a shell having concave exterior and interior surface portions 138,140, an inwardly extending annular lip 142, and a tapered central projection 144 depending from the interior surface portion 140, but does not include a second annular lip. The interior surface portion 140 has a plurality of annular grooves 146 formed therein about the projection 44. The relative diametric and axial dimensions of the base element 112 and the cap member 114 and of the opening 130 and the projection 144 are the same as above-described for the base element 12 and the cap member 14. Upon assembly, the base element 112 may be received in the receiving area 148 of the cap member 114 to varying extents and the projection 144 may be inserted into the opening 130 to varying depths to achieve varying degrees of radial expansion of the main body 118, determined in each instance in relation to the particular thickness of fabric covering 16 employed, all as above-described in regard to the base element 12 and the cap member 14. In assembly, at least some of the annular ridges 126 of the base element 112 and of the annular grooves 146 of the cap member 114 frictionally engage and hold the fabric edge portion 16' therebetween and the remaining ridges 126 and grooves 146 frictionally engage one another to aid in retaining the base element 112 and cap member 114 in assembly.

Another alternate embodiment of a base element 212 and a cap member 214 is shown in FIG. 5. In such embodiment, the base of element 212 is of a similar construction to that of the base element 112 of FIG. 4, including a main body 218 having a circular disk portion 220 and a generally frusto-conical portion 222 extending therefrom but does not include any annular ridges about the frusto-conical portion 222. As with the base element 112, the base element 212 includes a tapered central opening 230 in the main body 218, score lines 235 in the main body 218 extending radially outwardly from the opening 230, a flat underside 232 of the main body 218, and a central stem 234 with an eyelet 236 therein depending centrally from the underside 232. Unlike the base element 112, the base element 212 includes several annular ridges 260 formed in the periphery of its circular disk portion 220. The cap member 214 is of a similar construction to the cap member 114, the cap member 214 being formed as a shell having concave exterior and interior surface portions 238,240, an inwardly extending annular lip 242, and a tapered central projection 244 depending from the interior surface portion 240, but does not include annular grooves 146 in the interior surface portion 140. The relative dimensioning of the base element 212 and the cap member 214 and of the opening 230 and the projection 244 are the same as above-described for the base element 12 and the cap member 14. Upon assembly, the base element 212 may be received in the receiving area 248 of the cap member 214 to varying extents and the projection 244 may be inserted tinto the opening 230 to varying depths to achieve varying degrees of radial expansion of the main body 218, determined in each instance in relation to the particular thickness of the fabric covering 16 employed, all as above-described in regard to the base element 12 and the cap member 14. In assembly, the annular ridges 260 of the disk portion 220 of the base element 212 frictionally engage and hold the fabric covering 16 adjacent its edge portion 16' between the disk portion 220 and the interior surface portion 240 of the cap member 214 to aid in retaining the fabric covering 16 in taut covering relation on the cap member 214.

In each embodiment of the button assembly, the base elements 12 and 112 includes a plurality of teeth 50 depending from the underside 32,132 of the main body 18,118 in a circular arrangement concentrically about the stems 34 and 134. The teeth 50 are radially inwardly spaced from the annular edge of the main bodies 18 and 118 so as not to interfere with the fabric edge portion 16' or with the annular lips 42 and 142 in the assembled form of the button assembly, whereby the teeth 50 extend in the assembled form axially outwardly from the receiving areas 48 and 148 of the cap member 14,114. When the button assembly is affixed by the stems 34 and 134 to an upholstered furniture article (not shown) or the like, the teeth 50 engage and penetrate the surface of the article to which the button assembly is affixed and thereby effectively maintain it in place on the surface and act to prevent the undesirable withdrawal of the button assembly through the surface. The teeth 50 would normally be used in applications where the teeth 50 can readily penetrate the surface without damage thereto, such as when the surface is a woven fabric, but would not normally be with surface that might be torn by the teeth 50, such as leather.

The present button assembly offers distinct advantages over conventional button assemblies while as hereinbefore noted conventional button assemblies are substantially incapable of adaptation to differing fabric covering thicknesses without correspondingly changing the fixed relative dimensions of the button assembly components, the unique provision of the variable radial expansion capability of the base element of the present assembly permits the present button assembly to accept and adapt to a wide variety of differing fabric thicknesses and to provide a secure engagement of all such fabrics, without any needed variation in the size or any other structural change of any assembly component. The primary annular lip of the cap member acts to securely retain the base element and the cap member in assembly, and the engagement between the secondary annular lip 46 and the secondary body portion 26 in one embodiment and the engagement between the ridges 126 and the grooves 146 in the other embodiment provide supplemental retention of the base element and the cap member in assembly. Accordingly, the present button assembly is substantially usable with any ordinary fabric thickness and substantially prevents the occurrence of "button popping", i.e., the separation under stress of the cap member 14 from the base element 12, and thereby solves two of the principal problems existant in conventional button assemblies.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

We claim:

1. A button for receiving and securely holding in place a fabric covering therefor, comprising:

a. an expandable base element having a shaped fabric-engaging exterior surface portion and a second surface portion extending inwardly with respect to the periphery of said exterior surface portion, said base element being formed with an opening extending into said base element generally centrally of said exterior surface portion; and b. a cap member formed of resilient material and having an interior surface portion shaped to receive said base element for engaging fabric therebetween, said cap member having an annular lip extending inwardly for disposition immediately adjacent said second surface portion of said base element to resist removal thereof from said cap member and having projection means extending generally centrally from said interior surface portion for insertion into said opening of said base element, said projection means having at least a portion thereof which is larger than said opening and being shaped to cause increasing radial expansion of said base element as said projection is inserted to predetermined depths into said opening of said base element to locate said fabric-engaging exterior surface of said base element in corresponding predetermined fabric-engaging proximities to said interior surface of said cap member for securely holding therebetween fabrics of varying thicknesses.

2. A button according to claim 1 and characterized further in that said exterior surface portion of said base element is generally convex in shape and said interior surface portion of said cap member is generally concave in shape.

3. A button according to claim 2 and characterized further in that said exterior surface portion of said base element includes annular ridges for frictionally holding said fabric between said base element and said cap member.

4. A button according to claim 3 and characterized further in that said interior surface portion of said cap includes annular grooves for frictionally holding said fabric between said base element and said cap member.

5. A button according to claim 1 and characterized further in that said opening of said base element is inwardly tapered into said base element and said projection of said cap member is inwardly tapered along its projecting length for causing said increasing radial expansion of said base element in substantially direct relation to the depth of insertion of said projection in said opening.

6. A button according to claim 1 and characterized further in that said cap member includes a second annular lip extending from said interior surface portion about and inwardly toward said projection and said base element includes an annular recess about said opening to receive said second annular lip when said base element is received by said cap member.

7. A button according to claim 1 and characterized further in that said base element is scored along a line extending radially outwardly from said opening to facilitate expansion of said base element upon insertion of said projection into said opening.

8. A button according to claim 1 and characterized further in that said base element includes teeth extending from said second surface portion for penetrating a fabric surface to which said button assembly is mounted to maintain said button assembly in place on said fabric surface.

9. A button assembly for receiving and securely holding in place a fabric covering therefor, comprising:

a. a base element having a convex-shaped, fabric-engaging exterior surface portion and a generally-flat second surface portion extending inwardly with respect to the periphery of said exterior surface portion, said base element being formed with an opening extending at an inward taper thereinto generally centrally of said exterior surface portion, an annular recess about said opening, score lines extending in said exterior surface portion radially outwardly from said opening to facilitate expansion of said base element, and a plurality of teeth extending from said second surface portion for penetrating a fabric surface to which said button assembly is mounted to maintain said button assembly in place on said fabric surface, and b. a cap member formed of resilient material and having an interior surface portion concave-shaped to receive said base element for engaging fabric therebetween, said cap member having an annular lip extending inwardly for disposition immediately adjacent said second surface portion of said base element, a projection extending generally centrally from said interior surface portion at an inward taper along its projecting length and having at least a portion thereof which is larger than said opening for insertion into said opening of said base element for causing increasing radial expansion of said base element as said projection is inserted to predetermined depth into said opening in said base element, and having a second annular lip extending from said interior surface portion about and inwardly toward said projection to be received in said annular recess of said base element.

10. A button assembly for receiving and securely holding in place a fabric covering therefor, comprising:

a. a base element having a convex-shaped, fabric-engaging exterior surface portion and a generally-flat second surface portion extending inwardly with respect to the periphery of said exterior surface portion, said base element being formed with an opening extending at an inward taper thereinto generally centrally of said exterior surface portion, a plurality of annular ridges about said exterior surface portion, score lines extending in said exterior surface portion outwardly from said opening to facilitate expansion of said base element, and a plurality of teeth extending from said second surface portion for penetrating a fabric surface to which said button assembly is mounted to maintain said button assembly in place on said fabric surface, and b. a cap member formed of resilient material and having an interior surface portion concave-shaped to receive said base element for engaging fabric therebetween, said cap member having an annular lip extending inwardly for disposition immediately adjacent said second surface portion of said base element, a projection extending generally centrally from said interior surface portion at an inward taper along its projecting length and having at least a portion thereof which is larger than said opening for insertion into said opening of said base element for causing increasing radial expansion of said base element as said projection is inserted to predetermined depth into said opening in said base element, and having a plurality of annular grooves about said interior surface portion cooperative with said annular ridges of said base element for frictionally holding said fabric between said base element and said cap member.

11. A button assembly comprising:

a. a fabric piece, b. an expandable base element having a shaped fabric-engaging exterior surface portion and a second surface portion extending inwardly with respect to the periphery of said exterior surface portion, said base element being formed with an opening extending into said base element generally centrally of said exterior surface portion, and c. a cap member formed of resilient material having said fabric piece outwardly thereabout and having an interior surface portion shaped compatibly with and receiving said base element engaging the edge of said fabric piece therebetween, said cap member having an annular lip extending inwardly immediately adjacent said second surface portion of said base element to resist removal thereof from said cap member and having projection means having at least a portion thereof which is larger than said opening of said base element and extending generally centrally from said interior surface portion into said opening of said base element a predetermined depth causing radial expansion thereof to a corresponding predetermined degree in relation to the thickness of said fabric piece for secure engagement of said fabric piece between said base element and said cap member.

12. A button assembly according to claim 11 and characterized further in that said exterior surface portion of said base element is generally convex in shape and said interior surface portion of said cap member is generally concave in shape.

13. A button assembly according to claim 12 and characterized further in that said exterior surface portion of said base element includes annular ridges frictionally holding said fabric between said base element and said cap member.

14. A button assembly according to claim 13 and characterized further in that said interior surface portion of said cap includes annular grooves frictionally holding said fabric between said base element and said cap member.

15. A button assembly according to claim 11 and characterized further in that said opening of said base element is inwardly tapered into said base element and said projection of said cap member is inwardly tapered along its projecting length causing said radial expansion of said base member in substantially direct relation to the depth of insertion of said projection in said opening.

16. A button assembly according to claim 11 and characterized further in that said cap member includes a second annular lip extending from said interior surface portion about and inwardly toward said projection and said base element includes an annular recess about said opening receiving said second annular lip.

17. A button assembly according to claim 11 and characterized further in that said base element is scored along a line extending radially outwardly from said opening facilitating said expansion of said base element by said extension of said projection into said opening.

18. A button assembly according to claim 11 and characterized further in that said base element includes teeth extending from said second surface portion for penetrating a fabric surface to which said button assembly is mounted to maintain said button assembly in place on said fabric surface.

* * * * *

UNITED STATES PATENT OFFICE

CERTIFICATE OF CORRECTION

Patent No. 4,495,678 Dated January 29, 1985

Inventor(s) Charles R. Coley and J. Roger Hall

It is certified that error appears in the above-identified patent and that said Letters Patent are hereby corrected as shown below:

The following prior art cited by applicant was deleted from "References Cited" in patent:

| Patent Number | Issue Date | Issued To |
|---|---|---|
| 3,771,199 | November 13, 1973 | C. Eldringhoff |
| 3,341,904 | September 19, 1967 | V. F. Joyner |
| 4,198,733 | April 22, 1980 | B. A. Ferguson |
| 4,283,815 | August 18, 1981 | B. H. Henshaw |
| 4,344,240 | August 17, 1982 | K. H. Schiller |
| 3,528,693 | September 15, 1970 | A. S. Pearson |
| 3,816,881 | June 18, 1974 | R. W. VanRiper, Jr. |

Signed and Sealed this

*Twenty-fifth* Day of *March 1986*

[SEAL]

*Attest:*

DONALD J. QUIGG

*Attesting Officer*

*Commissioner of Patents and Trademarks*